US005078162A

United States Patent [19]

Moody

[11] Patent Number: 5,078,162

[45] Date of Patent: Jan. 7, 1992

[54] CLEANING APPARATUS FOR TUBES

[75] Inventor: Harry L. Moody, Saleme, Oreg.

[73] Assignee: Teledyne Industries, Inc.

[21] Appl. No.: 570,556

[22] Filed: Aug. 21, 1990

[51] Int. Cl.[5] ..... B08B 3/02; B08B 9/02

[52] U.S. Cl. ..... 134/104.1; 134/107; 134/140; 134/144; 134/152; 134/168 C

[58] Field of Search ..... 134/104.1, 107, 140, 134/144, 152, 167 C, 168 C; 15/104.05, 304; 118/DIG. 10

[56] References Cited

U.S. PATENT DOCUMENTS

| | | | |
|---|---|---|---|
| 1,982,590 | 11/1934 | Church et al. | 134/167 C X |
| 2,168,917 | 8/1939 | Perkins | 118/DIG. 10 |
| 2,336,946 | 12/1943 | Marden et al. | 118/DIG. 10 |
| 2,493,291 | 1/1950 | Hirsch | 134/152 X |
| 2,972,996 | 2/1961 | Phillips | 134/152 X |
| 3,858,552 | 1/1975 | Takata et al. | 118/DIG. 10 |
| 4,420,508 | 12/1983 | Gibson | 118/DIG. 10 |

FOREIGN PATENT DOCUMENTS

| | | | |
|---|---|---|---|
| 2825228 | 12/1979 | Fed. Rep. of Germany | 134/167 C |

*Primary Examiner*—Philip R. Coe

*Attorney, Agent, or Firm*—Shoemaker and Mattare, Ltd.

[57] ABSTRACT

The invention relates to an apparatus and process for removing lube and other contaminants from the inside of a tube, the apparatus comprising a flexible hose having a nozzle at one end thereof which is conveyed by a pair of pinch rollers through the length of the tube to be cleaned. A high pressure cleaning fluid is supplied to the nozzle and the pressurized fluid removes the lube and other contaminants from the inside of the tube. The apparatus seals both ends of the tube to be cleaned and provides drainage of the cleaning fluid from the interior of the tube. The apparatus can be used for automatic cleaning of tubes manufactured from a pilger reduction mill or other similar manufacturing process.

16 Claims, 5 Drawing Sheets

CLEANING APPARATUS FOR TUBES

The present invention relates to a apparatus for removing lube and other contaminates from the inside of a tube manufactured, for example, by a Pilger reduction mill.

BACKGROUND OF THE INVENTION

There are a variety of devices for spraying the inside of a pipe or other elongate cylindrical members, for instance see U.S. Pat. Nos. 2,494,380, 3,585,076, 3,600,225, 3,658,589, 4,107,001, 4,144,898, 4,312,679, 4,518,041 and 4,799,554. In addition, there is a known technique used for automatically removing lube contained on the inside of the tubes manufactured from a Pilger reduction mill operation which uses a caustic wash/rinse process. However, because there may be a significant time lapse between the manufacture of the tube and its actual cleaning with the caustic wash/rinse, the lube can cool and set thereby making it much more difficult to remove. In addition, the caustic solution used in the cleaning operation must be treated after use to make it environmentally acceptable for disposal.

A second known system for cleaning the inside of pipes is a system manufactured by Nuken Company of West Germany which employs a machine utilizing an elaborate wash/rinse system with low fluid pressure. This system can accommodate a fixed number of tubes per cleaning cycle, i.e. it is a batch operated system which requires a significant amount of operator attention. It utilizes a series of rigid lances which each have a nozzle at one end thereof for spraying a cleaning fluid about the inner periphery of the tubes. A major drawback of this system, however, is that it requires a large operating floor space in front of or behind the cleaning equipment which is at least equal to the length of the tubes being cleaned to allow the rigid lances to be inserted into and retracted from the tubes, e.g. a tube of 60' of length would require more than 60' of additional floor space in front of or behind the cleaning equipment.

A third known system, which is used in the manufacture of tubular heat exchangers, employs nozzles, hoses and water pressures similar to that of the present invention. However, in such systems, the nozzles and hoses are fed manually through the tubes of a heat exchanger tube bundle which is typically located at a fixed location.

Wherefore, it is a primary object of the invention to provide a system which is able to clean the interior of a tube immediately after it has been manufactured.

It is a further object of the invention to utilize an environmentally safe cleaning fluid, such as water which may include a biodegradable cleaning agent, thereby eliminating the use of caustic materials and simplifying the treatment of the cleaning fluid before it is discharged into the environment.

Another object of the invention is to provide a device which operates substantially automatically thereby to reduce the labor cost involved in cleaning the tubes.

A further object of the invention is to provide a device which is relatively compact and does not require a large operating area.

Another object of the invention is to provide a device which adequately seals and drains both ends of the pipe to be cleaned and thereby reduces the amount of splash and/or leakage of the cleaning fluid into the work area.

A still further object of the invention is to provide a device which is able to clean pipes of different diameters and lengths regardless of the type of materials from which such pipes are manufactured.

SUMMARY OF THE INVENTION

According to the present invention there is provided an apparatus, for cleaning a discrete length of tube or pipe by spraying a cleaning fluid to remove lube and other contaminates from the interior of that tube, comprising a support structure, hose support means, supported by said support structure, carrying a coiled length flexible hose having a nozzle at a distal end thereof, said hose being connected, at a proximal end thereof, with pump means for supplying high pressure cleaning fluid to said nozzle, clamp means, supported by said support structure for clamping a discrete length of tube to be cleaned to said apparatus, means for conveying and guiding said hose and nozzle into the interior of a said tube, and means, supported by said apparatus, for engaging both ends of a said tube to be cleaned connected to drainage means whereby said engagement means channel cleaning fluid sprayed into the interior of a said tube into said drainage means so that the work area adjacent said apparatus remains essentially free of cleaning fluid.

According to the present invention there is also provided a process, for cleaning a discrete length of tube or pipe by spraying a cleaning fluid to remove lube and other contaminates from the interior of that tube, on an apparatus having a support structure; hose support means, supported by said support structure, carrying a coiled length of flexible hose having a nozzle at a distal end thereof, said hose being connected, at a proximal end thereof, with pump means for supplying high pressure cleaning fluid to said nozzle; clamp means, supported by said support structure for clamping a discrete length of tube to be cleaned to said apparatus; means for conveying and guiding said hose and nozzle into the interior of a said tube; and means, supported by said apparatus, for engaging both ends of a said tube to be cleaned, connected to drainage means whereby said engagement means channels cleaning fluid sprayed into the interior of a said tube into said drainage means, said method comprising the steps of supplying a tube to the apparatus and clamping the tube with the clamp means engaging both ends of the tube with the engaging means, conveying the nozzle, via the guide and conveying means, within the interior of the tube, supplying cleaning fluid to the nozzle as it is conveyed within the tube, removing the nozzle from the tube after cleaning, disengaging both ends of the tube from the engaging means, unclamping the tube, and removing the tube from the apparatus.

BRIEF DESCRIPTION OF THE DRAWINGS

The invention will now be described, by way of example, with reference to the accompanying drawings in which.

Figure 3:
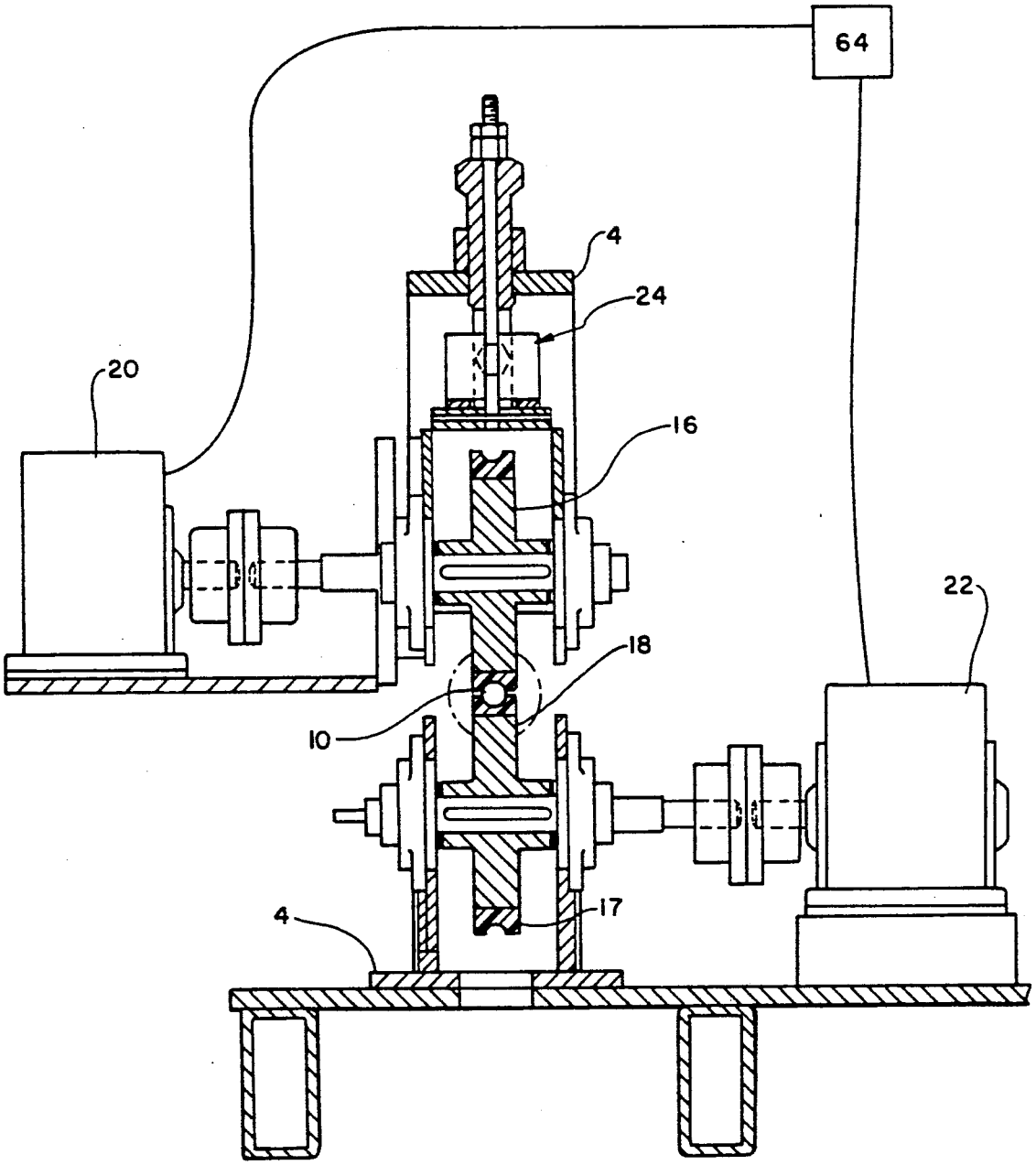
FIG. 3 is a cross-section on section line 3—3 of FIG. 1.
Figure 4:
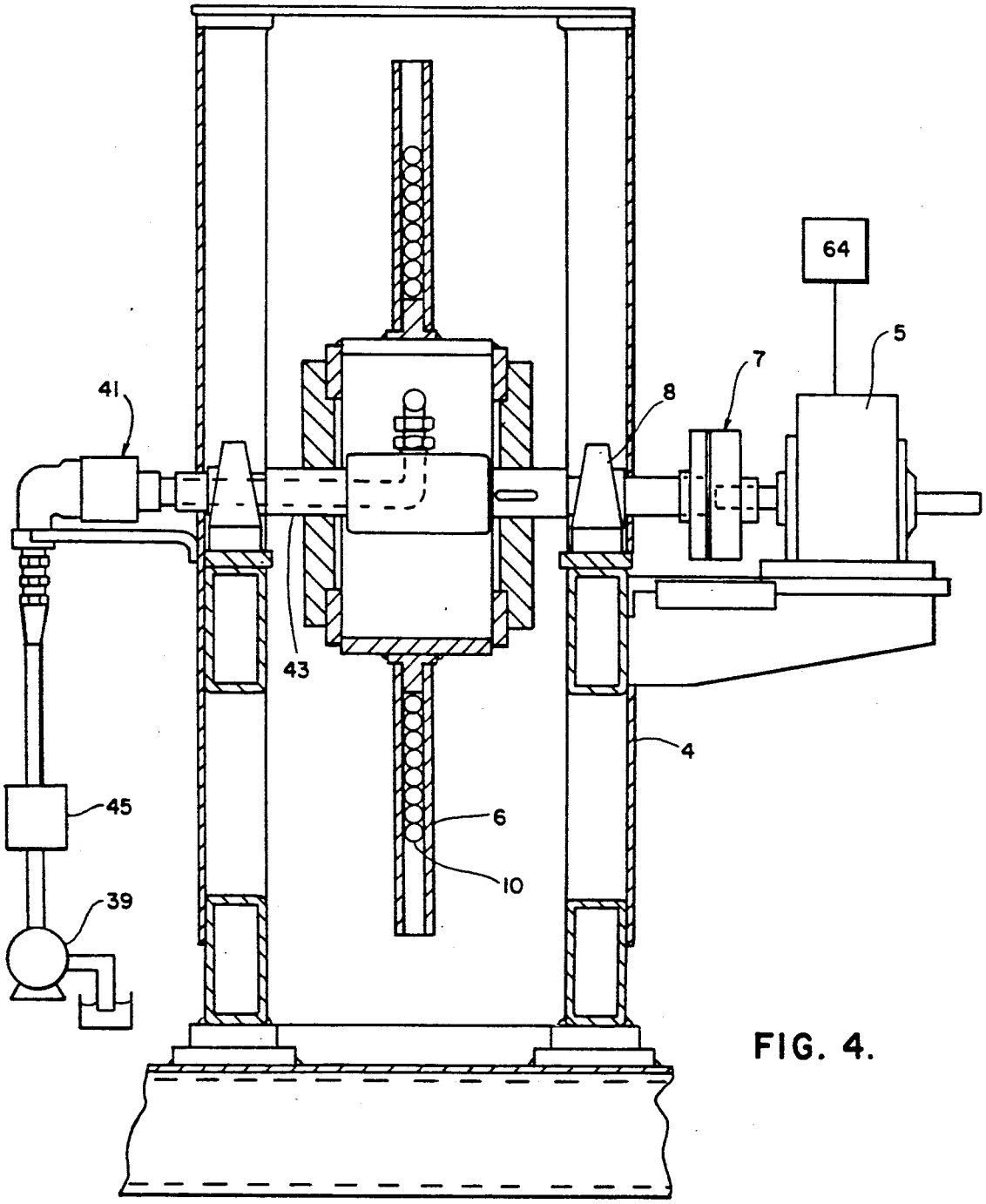
FIG. 4 is a cross-section on section line 4—4 of FIG. 1.

Turning now to the drawings, the cleaning apparatus of the present invention will be now described in detail. The apparatus 2 has a frame 4 supporting on one end thereof, via suitable bearing means 8, a reel 6 carrying a sufficient quantity of a flexible high pressure hose 10 wound on the reel in a single spiral layer. A motor 5 is connected with reel 6 (see FIG. 4), via a suitable drive connection, for dispensing or retracting the hose from the reel, as desired. An electric clutch 7 is used to regulate the hose tension on the reel 6. The high pressure hose 10 is guided by a pair of rotatable guide rollers 12, 14, supported by the frame 4, into the nip of a pair of 6 inch diameter pinch rollers 16, 18. If desired, a ⅜" thick UHMW polyethylene coating 17 or tire can be provided on the exterior of each roller to form the hose engaging surface of each pinch roller. The top pinch roller 16 is power by motor 20 (see FIG. 3), by a suitable drive connection, while the lower pinch roller 18 is powered by motor 22, by a suitable drive connection. Suitable driving power to the pinch rollers 16, 18 can be provided by ½ horsepower motors 20, 22. Alternatively, only one of the pinch rollers 16 or 18 may be driven by a motor with the other pinch roller 18 or 16 being an idler roller. In both arrangements, one pinch roller 16 is biased toward the other roller 18 by spring 24 having one end abutting a portion of the frame 4 and the opposite end abutting a slidable frame, supporting pinch roller 16, pinch roller 18 being fixedly supported by frame 4 so that suitable hose gripping pressure between the mating grooved surfaces of the pinch rollers and the hose 10 is achieved.

The pinch rollers 16, 18 convey, along with the reel 6, the hose 10 to and from a first housing 28. Suitable wiper means 26, such as rubber wiper or scrapper blades, surrounds and squeegees the entire outer circumference of the hose as it is conveyed to and fro. The wiper means is positioned between the pinch rollers and the first housing 28, preferably attached to the frame 4 adjacent the pinch rollers. The wiper means 26 removes any lube, water, biodegradable cleaning agents, etc., carried on the exterior surface of the hose thereby to minimize the slippage which may otherwise occur between the pinch rollers and the hose. The first housing 28 is provided with an elongate passage 31 having a plurality of drainage holes 30 in the lower portion the housing, for draining any fluid which is splashed or flows into the passage 31 during the spraying operation or which drips off the exterior surface of the hose during conveyance of the hose.

The distal end of the hose 10 is provided with a suitable coupling which is attached to a nozzle 32 having a plurality of nozzle outlets for injecting a high pressure cleaning fluid about the entire inner periphery of the pipe or tube 38 to be cleaned. A nozzle having eight back jets equally spaced about the outer perimeter of the nozzle has been found to perform a satisfactory spraying operation, but other types of nozzles could also be employed. Suitable nozzles can be obtained from the Jet Stream Company (e.g. FP-24-(7) ⅛" NPT, 0.468" Dia.) or the Weatherford Company both of Houston, Tex. The proximal end of the hose 10 is connected to suitable high pressure pump means 39 (see FIG. 4) via a rotary joint 41 and a hose connection coupling 43 contain within the interior of reel 6. The cleaning fluid is pumped and supplied to the rotary joint 41 at a pressure of between about 6,000 and about 10,000 psi. This provides a cleaning fluid pressure of about 4,000 to about 7,000 psi at the nozzle outlets and a flow rate of about 5 to 9 gallons per minute.

The cleaning fluid typically is water and may additionally contain a biodegradable cleaning agent which can be obtained from Amway Company. In addition, the cleaning fluid may be heated by suitable heating means 45 (see FIG. 4) to a temperature of between about 80° F. and about 212° F. to obtain more efficient cleaning of the tube.

Figure 5:
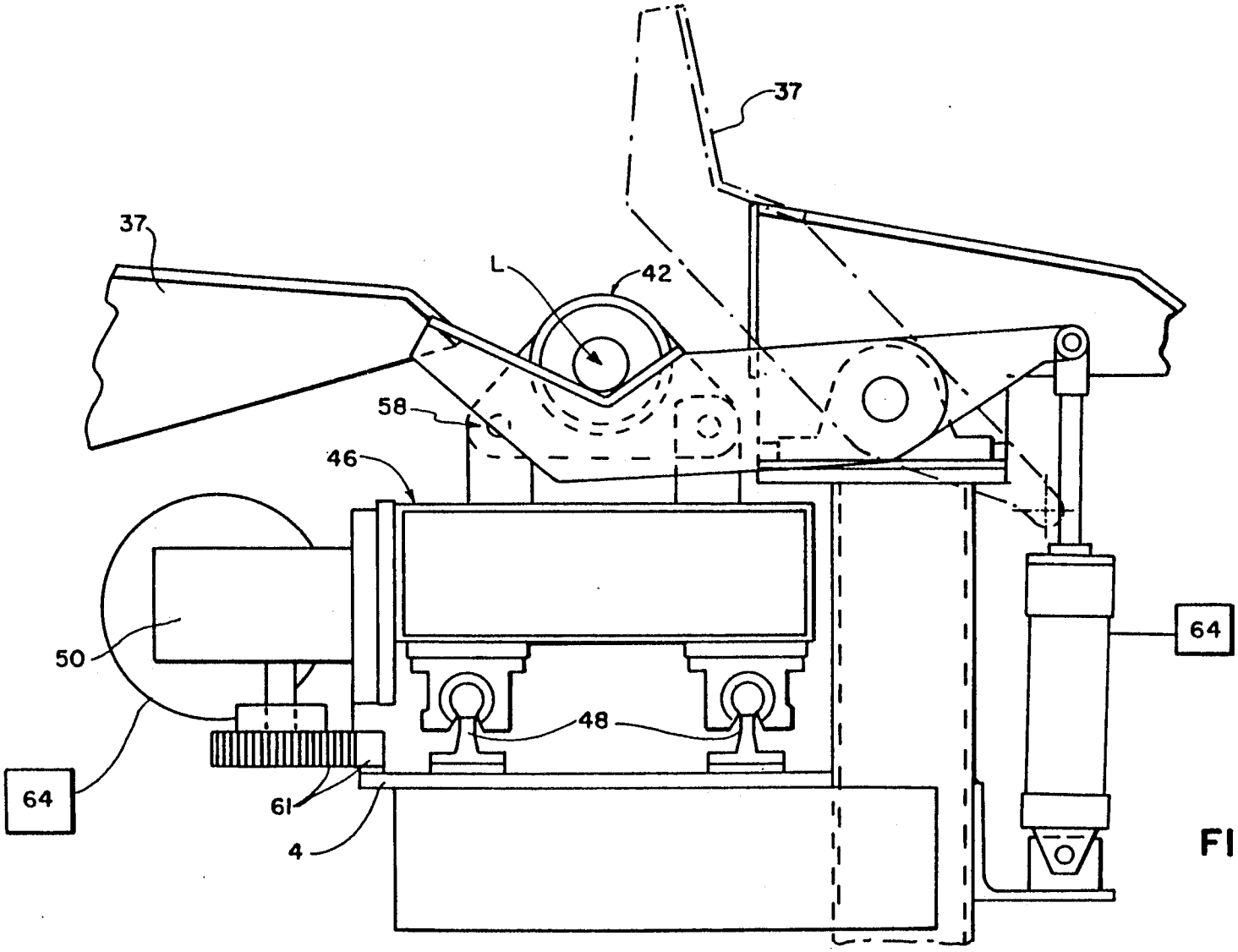
FIG. 5 is a cross-section taken between the headstock and the tailstock.

The passage 31 of the first housing 28 communicates with a re-entrant or chamfered opening 36, formed in a end of the housing remote from the pinch rollers, which has a frustoconical surface forming an included angle of about 60°. Due to the opening's frustoconical surface, opening 36 is able to provide sealing engagement with one end of a variety of different pipe sizes having outside diameters ranging from about ⅝" to 4". The pipe 38 to be cleaned is conveyed to the device 2 by automatic conveyor means 37 (see FIG. 5) which is only partially shown. A variety of conveyor arrangements would be suitable for the intended purpose and as these are well known to those in the art they are not discussed here in further detail. The pipe 38 is conveyed to clamping means 40, supported by the frame 4, where it is clamped to the cleaning apparatus 2 by a pair of hydraulically or pneumatically operated jaws or other similar clamping means 40. Once suitably clamped, the clamp means 40 is conveyed, by an air cylinder 47 supported on frame 4, toward the first housing 28 so that a first end of the tube 38 to be cleaned engages the opening 36 of the first house 28.

A second housing 42 (see FIG. 2) is supported by movable housing 46 which is conveyable along a pair of parallel rails 48 (see FIGS. 4 and 5), supported by the frame 4, by an air motor 50 and a rack and pinion arrangement 61. The second housing has a re-entrant or chamfered opening 44 formed in the end thereof substantially identical to and facing the re-entrant opening 36. The opening 44 communicates with a passage 51 and an outlet 52 which is connected to a suitable drain means 56 by a flexible conduit 57 for draining the sprayed cleaning fluid. The second housing 42 is supported via a pair of guide rods 58 and is biased toward the first housing 28 by springs 60. The movable housing 46 is conveyed toward the first housing so that the adjacent end of the pipe 38 to be cleaned engages the opening 44 of the second housing 42. Passage 31, opening 36, clamping means 40 and chamfered opening 44 are all centered on a longitudinal axis L of the cleaning apparatus 2 to facilitate centering engagement with the pipe 38 to be cleaned.

It is anticipated that at least the portion of the first and second housings 28, 42 defining the openings 36, 44, respectively, will be manufactured from UHMW polyethylene or another similar material. Alternatively, the housing could be manufactured from a metal or another durable plastics material and the openings 36, 44 lined with a thin UHMW polyethylene layer.

Figure 1:
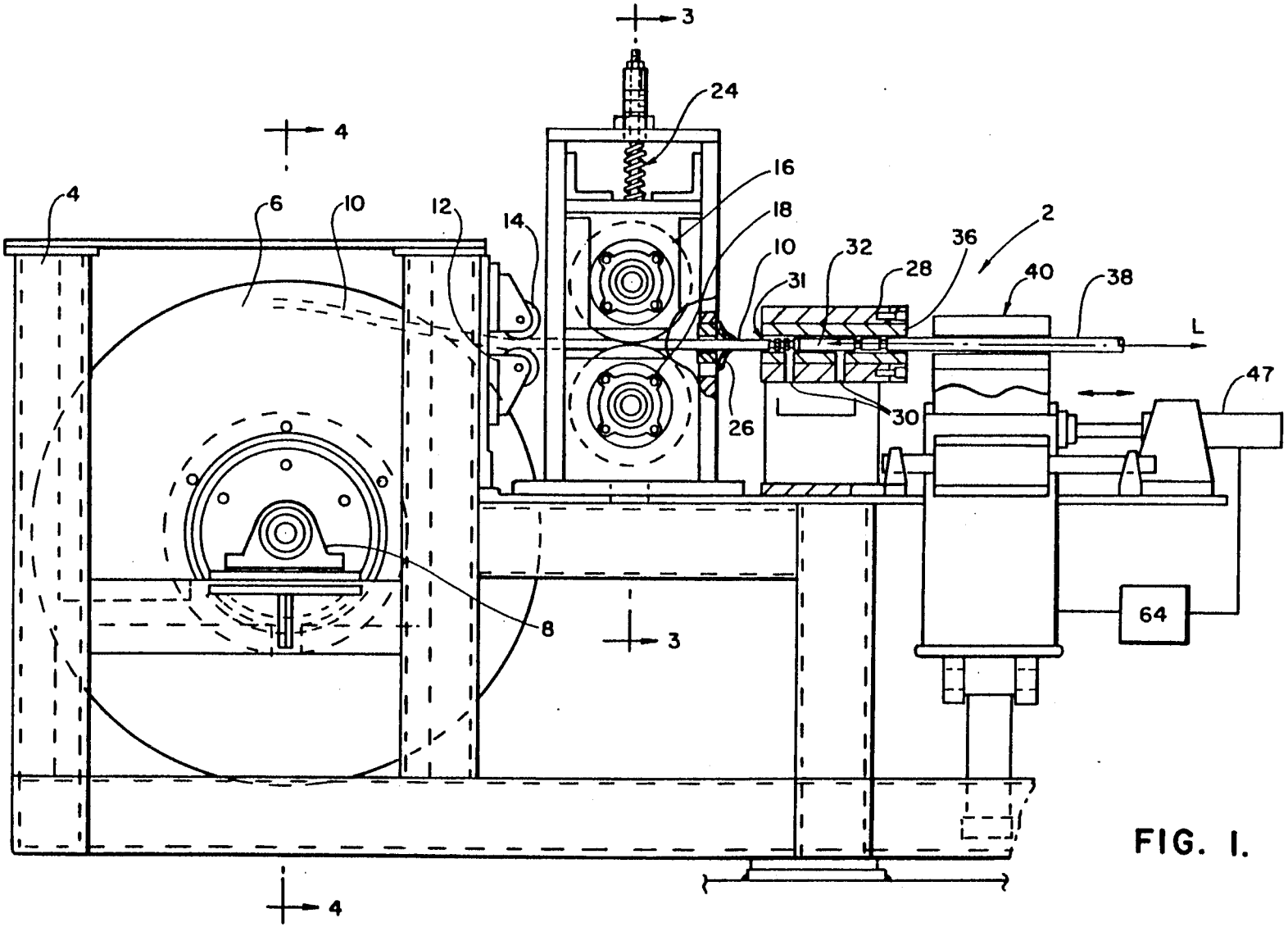
FIG. 1 is a diagrammatic partial elevation, shown partly in section, of the headstock of a cleaning apparatus according to the present invention.
Figure 2:
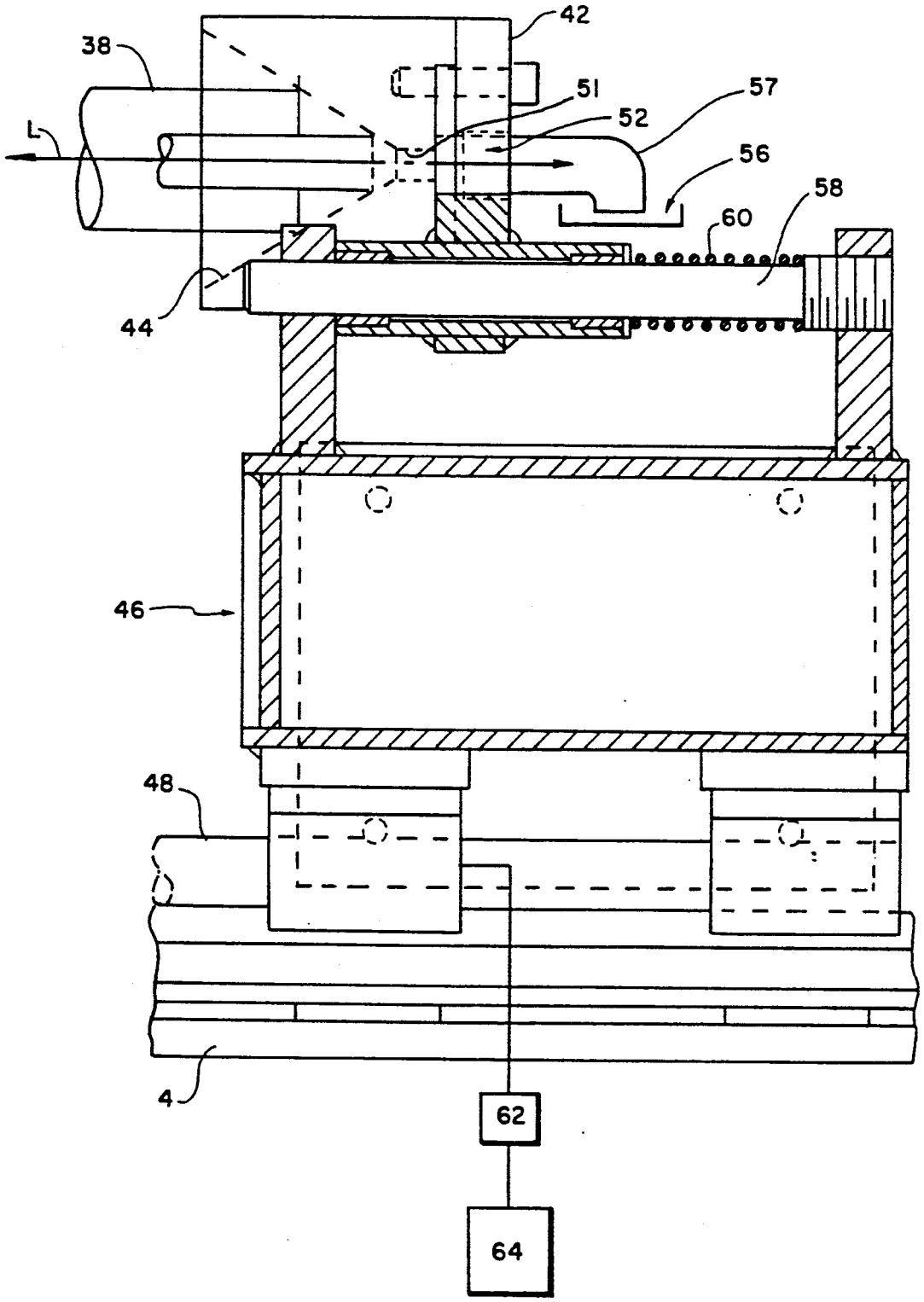
FIG. 2 is a diagrammatic partial elevation of the tailstock of cleaning apparatus according to the present invention.

Operation of the apparatus 2 is as follows. A pipe to be cleaned 38 is conveyed by the conveyor means 37 to the apparatus 2 and clamped by clamping means 40. Thereafter, the clamping means 40 is moved toward the first housing 28 by air cylinder 47 until the end of the tube 38 engages the opening 36. Then the movable assembly 46 is conveyed toward the first housing 28 until the opening 44 engages the opposite end of the pipe 38 and the second housing 42 compresses the springs 60, supported by the guide rods 58, to provide suitable sealing pressure between the tube and the opening. Once this occurs, the motor 50 stalls. The distance from the "home position" of the movable assembly 46 (the extreme far right initial starting position as shown in FIG. 2) to the stalled position can be measured by a digital counter 62 and used with a computer 64 to ascertain the length of the pipe 38 to be cleaned. This information is then used to control the motors 5, 20 and 22 so that they can dispense only the necessary length of hose 10 to spray the entire inner periphery of pipe 38 with fluid from the nozzle 32. Thereafter, the dispensed length of hose 10 is retracted by the pinch rollers 16, 18 and the reel 6, while spraying through the nozzle 32 continues, until the nozzle 32 is completely retracted into the passage 31 of the first housing 28 (see FIG. 1). Next, the movable assembly 46 is conveyed out of engagement with the pipe 38 (toward its "home position") by the air motor 50 and the clamping means 40 moves the pipe from opening 36 and releases the pipe 38 so that it can be removed by the automatic conveying means 37. Another pipe 38 to be cleaned can then be conveyed to the apparatus and the process repeated.

The supply of high pressure cleaning fluid is synchronized to be turned on and off at the beginning and end, respectively, of each individual cleaning cycle, i.e. as the nozzle enters and exits the pipe 38 in the apparatus 2.

Through use of the present invention, random lengths of tubes can be cleaned automatically with minimal operator attention. The tube is automatically inserted into the clamping device by automatic conveyor equipment 37, and the length of the tube 38 to be cleaned is sensed and readily determined by the computer 64 to determine the amount of hose to be conveyed into and from the tube 38. After the nozzle 32 traverses back and forth through the tube, the fluid pressure is turned off and the cleaned tube is automatically ejected from the clamping means 40. A new, dirty tube is then automatically clamped between the clamping means and the process is repeated.

Since certain changes may be made in the above described cleaning apparatus without departing from the spirit and scope of the invention herein involved, it is intended that all subject matter contained in the above description or shown in the accompanying drawings shall be interpreted as being illustrative of the invention and not limiting thereof.

Wherefore, I claim:

1. Apparatus, for cleaning a discrete length of tube by spraying a cleaning fluid to remove lube and other contaminates from the interior of that tube, comprising:

a) a support structure;

b) hose support means, supported by said support structure, carrying a coiled length of flexible hose having a nozzle at a distal end thereof, said hose being connected, at a proximal end thereof, with pump means for supplying high pressure cleaning fluid to said nozzle;

c) clamp means, supported by said support structure for clamping a discrete length of tube to be cleaned to said apparatus;

d) means for conveying and guiding said hose and nozzle into the interior of a said tube; and e) means, supported by said apparatus, for engaging both ends of a said tube to be cleaned, connected to drainage means whereby said engagement means channels cleaning fluid sprayed into the interior of a said tube into said drainage means.

2. An apparatus according to claim 1, wherein said hose support means is a rotatable reel defining an axis of rotation.

3. An apparatus according to claim 2, wherein said reel is provided with means for rotating said reel.

4. An apparatus according to claim 2, wherein said reel constrains said hose in a single spirally wound layer in a plane normal to said axis of rotation.

5. An apparatus according to claim 1, wherein said engaging means includes a stationary engaging means and a movable engaging means conveyable along said support structure, toward the stationary engaging means, by motor means for achieving sealing engagement of both ends of a said tube to be cleaned.

6. An apparatus according to claim 5, wherein each said engaging means comprises a housing having a re-entrant opening for engaging a said tube to be cleaned and a passage communicating with said re-entrant opening, said passage communicating with said drainage means for draining sprayed cleaning fluid from the interior of a said tube.

7. An apparatus according to claim 6, wherein the re-entrant opening of each of said housings is surfaced with UHMW polyethylene.

8. An apparatus according to claim 5, wherein said stationary engaging means is fixedly supported by said support structure and said clamping means is conveyable toward said fixed engaging means.

9. An apparatus according to claim 8, wherein said movable engaging means is conveyable toward said stationary engaging means after conveyance of said clamping means.

10. An apparatus according to claim 1, wherein a pair of mating pinch rollers is provided for conveying the flexible hose and nozzle into and out of a said tube to be cleaned.

11. An apparatus according to claim 10, wherein at least one of said pinch rollers is driven by motor means and at least one of said pinch rollers is spring biased toward the other pinch roller to provide suitable gripping pressure of the flexible hose by said pinch rollers.

12. An apparatus according to claim 11, wherein both of said pinch rollers are driven by motor means.

13. An apparatus according to claim 11, wherein wiper means is provided, adjacent said pair of pinch rollers, for removing lube, cleaning fluid and other contaminants from the exterior surface of the flexible hose to minimize slippage which may otherwise occur between said pair of pinch rollers and said hose.

14. An apparatus according to claim 1, wherein said hose support means is rotatable by motor means and a pair of pinch rollers is provided for conveying the flexible hose and nozzle into and out of said tube to be cleaned, at least one of said pinch rollers is driven by motor means.

15. An apparatus according to claim 14, wherein said pump means supplies the cleaning fluid to said nozzle at a pressure of between about 4,000 to about 7,000 psi.

16. An apparatus according to claim 15, wherein heating means heats the cleaning fluid to a temperature of from about 80° to about 212° F. before being supplied to the nozzle.

* * * * *